US008836232B2

(12) United States Patent
Bailey et al.

(10) Patent No.: US 8,836,232 B2
(45) Date of Patent: Sep. 16, 2014

(54) ADJUSTABLE LIGHT FIXTURE

(75) Inventors: Michael Bailey, Carlsbad, CA (US); George Seelman, Temecula, CA (US); Jay Stone, San Marcos, CA (US); Michael Lamb, Rancho Santa Fe, CA (US)

(73) Assignee: Ecolink Intelligent Technology, Inc., Carlsbad, CA (US)

( * ) Notice: Subject to any disclaimer, the term of this patent is extended or adjusted under 35 U.S.C. 154(b) by 273 days.

(21) Appl. No.: 13/227,419

(22) Filed: Sep. 7, 2011

(65) Prior Publication Data

US 2013/0057177 A1 Mar. 7, 2013

(51) Int. Cl.
*H05B 37/02* (2006.01)

(52) U.S. Cl.
CPC ..... *H05B 37/029* (2013.01)
USPC ..... 315/291; 315/294; 315/362

(58) Field of Classification Search
USPC ..... 315/209 R, 225, 291, 294, 307, 360, 362
See application file for complete search history.

(56) References Cited

U.S. PATENT DOCUMENTS

| | | | | |
|---|---|---|---|---|
| 5,939,835 | A * | 8/1999 | Takeda et al. | 315/209 R |
| 7,772,786 | B2 * | 8/2010 | Hosoda et al. | 315/291 |
| 2002/0084890 | A1 * | 7/2002 | Guerrieri et al. | 340/332 |
| 2003/0209654 | A1 * | 11/2003 | Smith | 250/214 SW |
| 2009/0222068 | A1 * | 9/2009 | Oberreiter et al. | 607/88 |

* cited by examiner

*Primary Examiner* — Tung X Le
(74) *Attorney, Agent, or Firm* — Thomas Thibault

(57) ABSTRACT

Methods and apparatus for controlling a light fixture having at least one adjustable attribute are described. In one embodiment, a light fixture having at least one adjustable attribute comprises a housing, a light source disposed within the housing, a cover secured to the housing that allows at least some light from the light source to pass, a light control circuit, coupled to the light source and disposed within the housing, for detecting a state change of a switch and for providing a control signal for varying an attribute of the light fixture, and the switch, coupled to the light control circuit and disposed within the housing, comprising contacts that are opened and closed in response to a non-mechanical stimulus external to the housing.

10 Claims, 4 Drawing Sheets

ADJUSTABLE LIGHT FIXTURE

BACKGROUND

I. Field of Use

The present application relates to the field of lighting. More specifically, the present application relates to changing attributes of a light generated by a light fixture.

II. Description of the Related Art

Adjustable lighting has been around for years, allowing users to change attributes of light generated by light fixtures such as light intensity. Generally, a dimmer switch or other adjustable control mechanism is used to achieve this effect by varying the voltage applied to the light fixture.

Adjustable lighting is also a desired feature for outdoor lighting. Such lighting provides homeowners to illuminate their homes and landscaping, not just for safety reasons, but for aesthetic purposes. There exists a great variety of outdoor lighting and control systems available to consumers, including solar walkway lighting, multi-colored lighting, automatic lighting control systems, zone lighting control systems, etc.

Outdoor lighting systems typically comprise one or more transformers to convert high-voltage, 120 volt AC down to a lower voltage, such as 48 volts AC. Several outdoor lighting fixtures may be connected to the transformer. Each lighting fixture may be customized to provide a desired light intensity, color, and/or beam angle, depending on its location and the subject of the illumination. For example, it is common practice to "uplight" palm trees using relatively high-power bulbs while directing light upward in a narrow beam angle.

Unfortunately, selecting the correct bulb to obtain desired lighting characteristics often involves a time-consuming processes of trial and error. Outdoor lighting installers generally swap a number of bulbs into each lighting fixture to obtain a desired lighting result. This typically involves disassembling lighting fixtures to gain access to existing bulbs, removing existing bulbs, inserting new bulbs, re-assembling the fixtures, powering the lighting fixtures on, and observing the new results.

Another problem with outdoor lights is that, over time, traditional lighting fixtures erode due to the fact that they are constantly exposed to moisture and wide temperature swings. In order to keep moisture from reaching the interior portion of lighting fixtures, i.e., where the bulb is located, one or more pliable seals, O-rings, and/or grommets are used to provide a moisture barrier between two or more mechanical joints, seems, or removable items. For example, many outdoor lighting fixtures use a rubber O-ring to seal a screwable, translucent cap onto a base of the lighting fixture.

To combat this environmental problem, and for increased power efficiency, energy-saving lighting fixtures using light emitting diodes (LEDs) are beginning to become commonplace. Outdoor LED fixtures typically comprise a sealed mechanical structure that houses one or more LEDs that provide light at a fixed power level, fixed color, and a fixed beam angle. Thus, in order any of these attributes, an entire LED lighting fixture must be replaced by another having different lighting attributes. Not only is this process even more time-consuming than changing bulbs in ordinary fixtures, but a large inventory of fixtures, each having different light intensities, colors, and/or beam angles, must generally be purchased, stored, and transported by outdoor lighting installers, resulting in high overhead costs for such professionals.

Thus, it would be desirable to provide outdoor lighting fixtures having adjustable light attributes, while permanently sealing such fixtures to eliminate wear from environmental factors.

SUMMARY

The embodiments described herein relate to methods and apparatus for controlling a light fixture having at least one adjustable attribute. In one embodiment, a light fixture having at least one adjustable attribute comprises a housing, a light source disposed within the housing, a cover secured to the housing that allows at least some light from the light source to pass, a light control circuit, coupled to the light source and disposed within the housing, for detecting a state change of a switch and for providing a control signal for varying an attribute of the light fixture, and the switch, coupled to the light control circuit and disposed within the housing, comprising contacts that are opened and closed in response to a non-mechanical stimulus external to the housing.

In another embodiment, a method for controlling an attribute of a light fixture comprises detecting application of a non-mechanical stimulus to the light fixture, changing the state of a switch from a first position to a second position in response to detecting application of the non-mechanical stimulus, detecting removal of the non-mechanical stimulus from the light fixture, changing the state of the switch from the second position to the first position in response to detecting removal of the non-mechanical stimulus, determining that the non-mechanical stimulus has been removed from the light fixture within a predetermined time period after the non-mechanical stimulus was applied to the light fixture, and in response to determining that the non-mechanical stimulus was removed from the light fixture within the predetermined time period after the non-mechanical stimulus was applied to the light fixture, causing changing an attribute of the light fixture in accordance with a predetermined attribute setting.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

The present description relates to a light fixture having adjustable attributes, particularly such a light fixture for outdoor use. It has long been desired to alter attributes of lights, such as intensity, color, and/or beam angle in a convenient, economical manner in an outdoor setting. In the past, this has been achieved by changing bulbs and/or fixtures to achieve desired lighting results. However, this practice is becoming less available, due to the popularity of LED light fixtures that are typically sealed to protect internal LED elements from moisture that is commonly found in outdoor settings. It is thus desirable to provide outdoor light fixtures that are sealed against outdoor elements, while still allowing control over features such as light intensity, beam angle, color, and/or other attributes. Accordingly, a light fixture is disclosed that uses a non-mechanical stimulus to alter lighting features.

Figure 1:
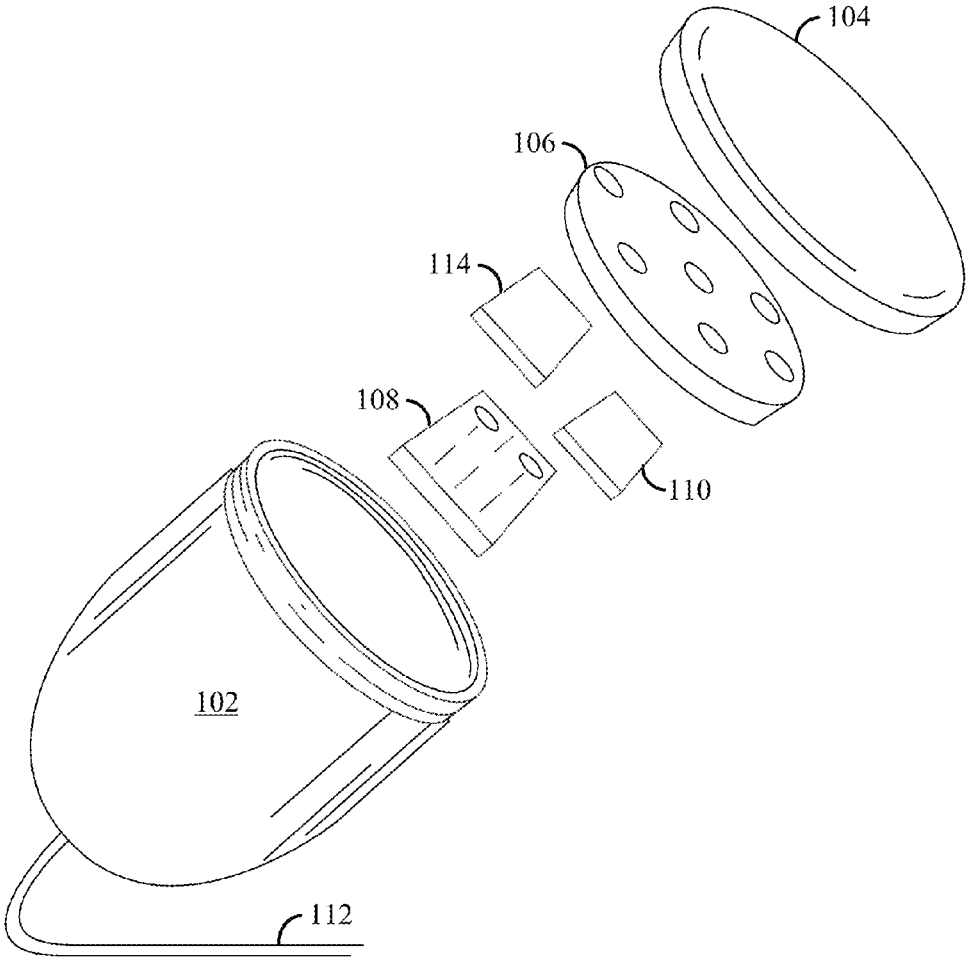
FIG. 1 illustrates an exploded view of one embodiment of an adjustable light fixture 100 in accordance with the teachings herein.

FIG. 1 illustrates an exploded view of one embodiment of an adjustable light fixture 100 in accordance with the teachings herein. Light fixture 100 is typically used in outdoor environments to provide a variety of lighting solutions to homeowners, landscapers, business owners, etc. Shown are housing 102, cover 104, light source 106, lighting control circuit 108, switch 110, and voltage generator 114. Connecting wires have been omitted for purposes of clarity. Switch 110, control circuit 108, voltage generator 114, and light source 106 are normally enclosed inside housing 102. Cover 104 seals these components inside housing 102, either using a removable arrangement such as a threaded arrangement with housing 102, or it may be "permanently" attached to housing 102 once the components have been installed inside housing 102.

Light fixture 100 provides light as a voltage is applied to light source 106, controlled by control circuit 108 and powered by voltage generator 114. Control circuit 108 comprises discreet and/or integrated circuits to detect state changes of switch 110 as well as to provide control signals to voltage generator 114. Voltage generator 114 comprises discreet and/or integrated circuits to generate voltages for use by light source 106 in accordance with control signals provided by light control circuit 108. External power is supplied to light fixture 100 via wiring 112, typically as a low-voltage AC signal provided by a transformer.

At least a portion of cover 104 typically comprises a transparent or semi-transparent material, allowing light generated by light source 106 to pass. Switch 110 may be mounted anywhere within housing 102, including on control circuit 108 and is electronically coupled to control circuit 108. Operation of switch 110 is accomplished by non-mechanical stimulus, such as a magnetic field, electric field, optical stimulus, etc. Switch 102 resides completely within housing 102 after assembly of light fixture 100.

Light source 106 comprises one or more light-emitting devices, such as light-emitting diodes (LEDs), incandescent bulbs, compact fluorescent bulbs, organic light emitting diodes (OLEDs), field emission displays (FEDs), quantum-dot-based light-emitting devices (QLEDs), or virtually any other light-emitting device. The light-emitting devices may have varying attributes from one another, such as different colors and/or intensities.

Figure 2:
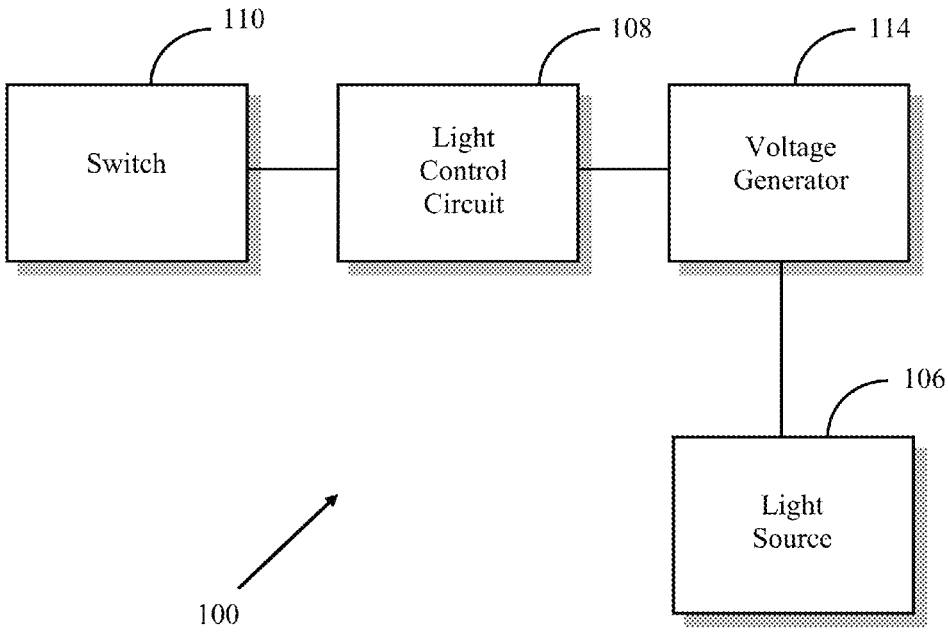
FIG. 2 is a functional block diagram of one embodiment of the adjustable light fixture shown in FIG. 1.

FIG. 2 is a functional block diagram of one embodiment of the adjustable light fixture 100 shown in FIG. 1 in accordance with the teachings herein. Shown are functional representations of switch 110, light control circuit 108, voltage generator 114, and light source 106. Switch 102 comprises a switch having one or more contacts, allowing the switch to operate in one or more "open" or "closed" positions. The switch is operated by a "non-mechanical stimulus", e.g., an electric or magnetic field, an optical stimulus, or any other stimulus that causes a state change of the switch, e.g., from open to closed or from closed to open, without a need to come in physical contact with switch 110 or fixture 100.

In one embodiment, switch 110 comprises a reed switch. A reed switch is an switch that is operated using a magnetic field, typically comprising a pair of contacts positioned on ferrous metal reeds in a hermetically sealed glass envelope. The contacts may be normally open, closing when a magnetic field is applied, or normally closed and opening when a magnetic field is applied. The switch is typically operated by bringing a magnet in close proximity to the switch, which causes it to change state. When the magnet is removed, the switch typically reverts back to its original state.

Light control circuit 108 comprises circuitry to detect state changes of switch 110 and to provide control signals to voltage generator 114 to control one or more attributes of light source 106, such as light intensity, beam angle, color, power consumption, temperature, and/or other attributes. Voltage generator 114 typically comprises a circuit that generates a voltage waveform dependent on the control signal from light control circuit 108. For example, in one embodiment, voltage generator 114 comprises a PWM circuit that generates AC voltages having varying duty cycles dependent upon the control signal from light control circuit 108. Pulse-width modulation varies the duty-cycle of a waveform to achieve varying average voltage levels. The higher the duty cycle, the greater average voltage is applied to light source 106 (and, hence, the greater light intensity of light source 106) and vice-versa. In another embodiment, voltage generator 114 comprises an amplifier that generates a voltage proportional to the control signal provided by light control circuit 108. In yet another embodiment, voltage generator 114 comprises a series of outputs, each output for driving one or more light-emitting devices that comprise light source 106.

Light source 106 comprises one or more LEDs, OLEDs, incandescent bulbs, compact fluorescent bulbs, QLEDs, FEDs, and/or other types of light-emitting devices. The intensity of the light produced by light source 106 may be altered in a number of ways. For example, in one embodiment, the light intensity of light source 106 is varied in accordance with a current or a voltage that is applied to it from voltage generator 114. In another embodiment, the light intensity is varied in accordance with a modulated voltage, such as a pulse-width-modulated (PWM) voltage from voltage generator 114. In yet another embodiment, light source 106 comprises a number of individual light-emitting devices and the light intensity is varied as a greater, or fewer, of the individual light-emitting devices are energized by voltage generator 114.

In an embodiment where switch 110 comprises a reed switch, when a magnet is brought in close proximity to the switch (i.e., housing 102), switch 110 changes state. When this occurs, the contact within switch 110 closes, and light control circuit 108 senses this condition. For example, in an open position, a voltage sensed by control circuit 108 is in a "high" condition, e.g., +5 volts. As a magnet is brought in close proximity to light fixture 100, a magnetic field produced by the magnet causes switch 110 to change state to a closed position. In the closed position, the voltage sensed by control circuit 108 falls to a "low" condition, e.g., 0 volts. The voltage sensed by control circuit 108 may be provided to one or "flip-flops", a common electronic component that senses voltage transitions. The output of the one or more flip-flops may be provided to PWM circuitry, where it is used to produce waveforms of varying duty cycles and/or amplitude. These waveforms are provided to light source 106 as a source for generating light proportional to the duty cycle and/or amplitude. For example, waveforms with high duty cycles produce more light intensity than waveforms having lower duty cycles. Thus, by sensing the state change of switch 110 each time a magnet is brought in close proximity to fixture 100, an attribute of the light fixture 100 may be altered. Other attributes comprise color, beam angle, power consumption, temperature, and/or other features of light fixture 100.

Of course, there are many other ways known in the art to use the state changes of switch 110 to generate waveforms having different duty cycles. Any of these alternative ways could be used.

Figure 3:
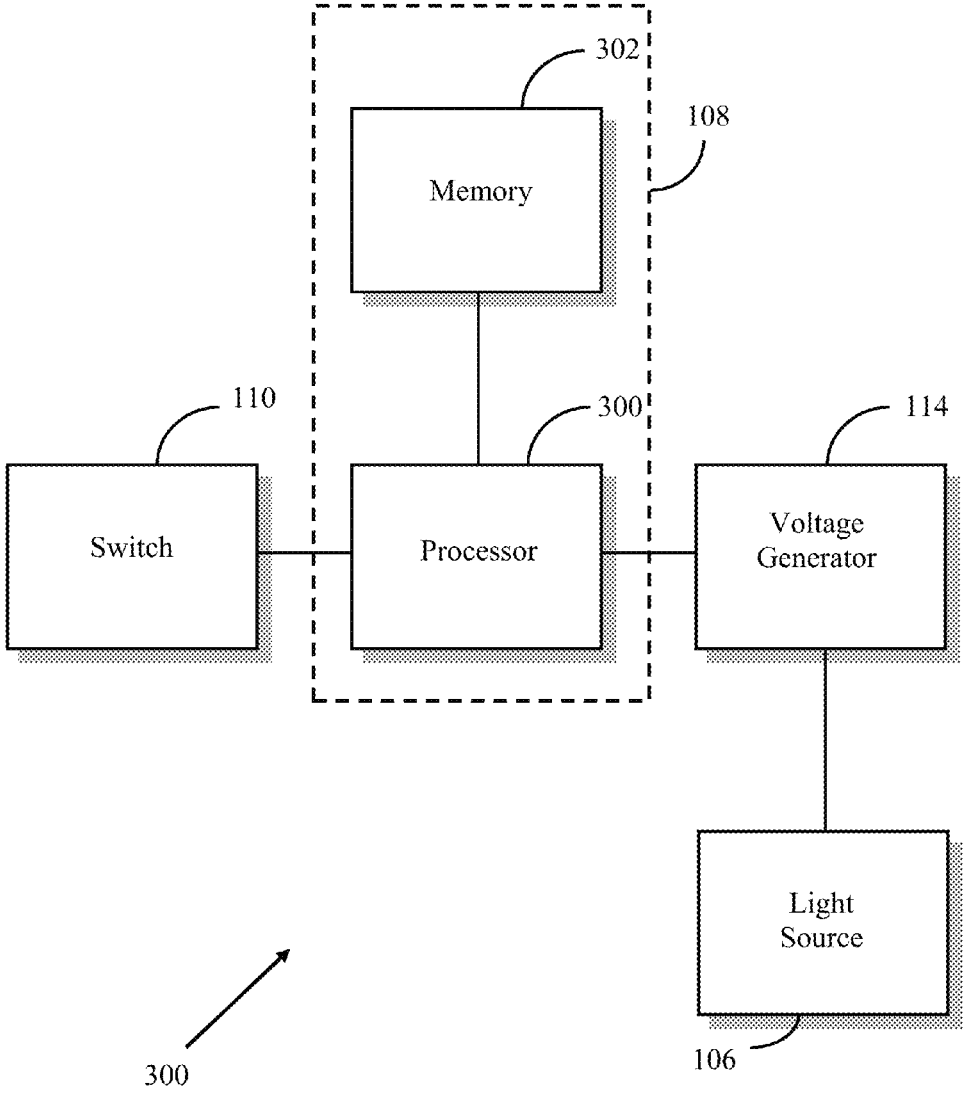
FIG. 3 is a functional block diagram of another embodiment of the adjustable light fixture 100 shown in FIG. 1.

FIG. 3 is a functional block diagram of another embodiment of the adjustable light fixture 100 shown in FIG. 1. In this embodiment, light control circuitry 108 comprises processor 300 and memory 302 to sense state changes of switch 304 and provide control of light source 106 in accordance with the state changes.

Processor 300 is configured to provide control of light source 106 by executing processor-executable instructions stored in memory 202, for example, executable code. Processor 200 typically comprises a general purpose processor, such as an ADuC7024 analog microcontroller manufactured by Analog Devices, Inc. of Norwood Mass., although any one of a variety of microprocessors, microcomputers, and/or microcontrollers may be used alternatively.

Memory 202 comprises one or more information storage devices, such as RAM, ROM, EEPROM, UVPROM, flash memory, CD, DVD, Memory Stick, SD memory, XD memory, thumb drive, or virtually any other type of electronic, optical, or mechanical memory device. Memory 202 is used to store the processor-executable instructions for operation of light source 106 as well as any information used by processor 200, such as one or more variable-intensity lighting patterns, as will be discussed below.

In FIG. 3, processor 300 senses switch states of switch 110 and uses this information to vary one or more attributes of light source 106 via voltage generator 114. For example, processor 300 may access memory 302 each time a state change occurs and, for each state change, retrieve instructions to alter a light-intensity level of light source 106 by a given amount. The instructions could comprise numerical information specifying a voltage or current level, a plurality of levels, a time-varying level, etc. Processor 300 may then generate one or more control signals based on the instructions to vary, for example, the intensity of light source 106 via voltage generator 114. For example, an output of processor 300 may control an amplifier as part of voltage generator 114 that provides a varying voltage to light source 106 based on the signal from processor 300. In another embodiment, a control signal from processor 300 may control the duty cycle of a time-varying voltage generated by a PWM circuit as part of voltage generator 114.

In one example, memory 302 may contain information relating to three potential operating intensities of light source 106: high, medium, and low. While operating in a high-intensity mode of operation, processor 110 may detect a state change of switch 110. In response, processor 302 may determine, from memory 302, that the next operating condition is "medium". In response, processor 302 provides a control signal to voltage generator 114, instructing voltage generator 114 to provide a voltage to light source 106 commensurate with a medium-intensity light output. When a subsequent state change of switch 110 is detected by processor 300, memory 302 is again consulted, this time indicating that the light intensity should be changed to "low". Processor 300 then provides another control signal to voltage generator 114 to provide a voltage representative of a low light intensity to light source 106. When yet another, subsequent state change of switch 110 is detected by processor 300, an indication in memory 202 may instruct processor to return to the high-intensity mode. Thus, with each state change, processor 300 generates a control signal instructing voltage generator 114 to provide voltages to light source 106 to achieve high, medium, and low light intensities in a cyclical fashion.

The use of processor 300 and memory 301 as control circuitry 108 enables more options to control light source 106 other than providing discreet light intensity levels, as discussed above. For example, in one embodiment, memory 302 could store one or more variable-intensity lighting patterns for providing custom control of light source 106. Each variable-intensity lighting pattern typically comprises information or instructions that cause processor 300 to vary light source 106 in a particular manner. For example, one of these variable-intensity lighting patterns may comprise a cyclical repetition of a first time period of increasing light intensity followed by a second time period of decreasing light intensity. To achieve this result, a series of values representing increasing and decreasing voltages, current, and/or duty cycles may be stored in memory 302. Other patterns could include a sinusoidal light intensity variation, a "stair-stepped" light intensity variation, or virtually any type of time-varying light intensity variation.

Figure 4:
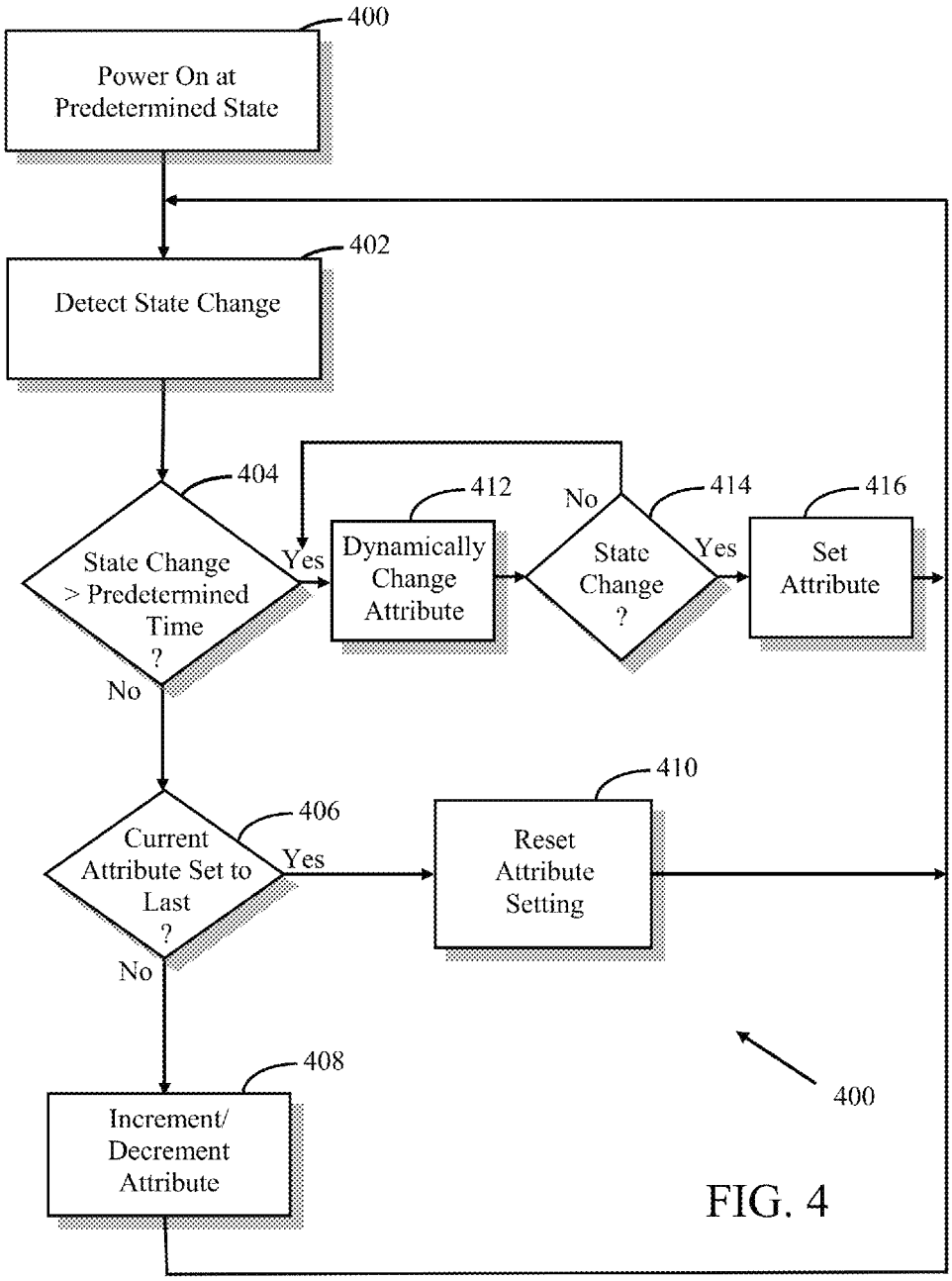
FIG. 4 is a flow diagram illustrating one embodiment of a method for controlling an attribute of a configurable light fixture.

FIG. 4 is a flow diagram illustrating one embodiment of a method for controlling one or more attributes of a light fixture. In this embodiment, a revolving, or cyclic, series of attribute settings are stored in memory 202. For example, in one embodiment where a configurable attribute comprise light color, the attribute settings may comprise red, blue, and green, along with instructions indicating an order in which the colors are to be changed. The instructions may specify that the light color should be changed from red, to blue, to green, and then back to red, repeating the cycle, upon each state change of switch 110. In another embodiment, an attribute comprises a light intensity level, and attribute settings comprise low, medium, and high intensity levels. Instructions stored in memory 202 may specify that the light intensity levels should be incremented from low, to medium, to high, and then back down to the low setting upon detection of each state change of switch 110. Each attribute may have a number of settings associated with it.

At block 400, power is applied to a light fixture, such as the one shown in FIG. 1. Typically, a low-voltage AC signal, such as 48 volts, AC, is applied from a transformer to the light fixture. Upon power on, the light fixture may enter a default mode of operation, such as in a high intensity light output state or producing a "white" light. In another embodiment, the light fixture may be powered on having one or more attributes randomly instituted.

At block 402, a state change of switch 110 is detected by light control circuit 108. The state change of switch 110 is accomplished by positioning a non-mechanical stimulus, such as a magnetic field, in close proximity to switch 110 as it is housed inside housing 102, typically by placing a magnet near housing 102, when switch 110 comprises a reed switch. A state change of switch 110 comprises an opening or closing of switch contacts, placing switch 110 in a closed position from an open position, or in an open position from a closed. In other embodiments, switch 110 comprises a structure that is operated by application of an electric field or optical stimulus. Such structures are well-known in the art.

At block 404, processor 300 determines if the state change in block 402 remains changed for a time period exceeding a predetermined time period, such as three seconds. If not, this is an indication that a user wishes to change an attribute to a new, predetermined setting, and processing continues to block 406.

At block 406, processor 300 determines whether an attribute currently set is the last in a series of attributes. For example, memory 302 may store three settings for the color of light from light fixture 100, e.g., red, blue, and green and instructions to change from red, to blue, to green, then back to red upon each state change of switch 110. In another embodiment, five light intensity levels may be stored in memory 202 with instructions to increment the light intensity each time a state change is detected in switch 110. Upon reaching the most intense level, the instructions indicate that the lowest intensity level is used upon the next state change of switch 110. In general, processor 200 uses the instructions stored within memory 202 to determine whether the present attribute is the last attribute in a revolving series. If the present attribute setting is not the last attribute in the series, processing continues to block 408, where the next attribute in the series is used to control light source 106, whether it is an increase in light intensity, a decrease in light intensity, changing to a different color, changing to a wider beam angle, changing to a more narrow beam angle, etc.

If the present attribute setting at block 406 is the last attribute setting in the series, processing continues to block 410, where the attribute setting is "reset", e.g., the first or last attribute setting in the series is used by processor 200 to control operation of light source 106.

After blocks 408 or 410 are complete, processing continues back to block 402, where processor 200 determines whether there has been another state change of switch 110.

Back at block 404, if the state change of switch 110 is maintained for more than a predetermined time period, this is an indication that a user wishes to set an attribute of the light fixture to a "custom" setting, and processing continues to block 412, where a "dynamic" mode of operation is entered. The dynamic mode may be defined as changing one or more light source attributes on a continuous basis. For example, if the attribute is light intensity, then the dynamic mode of operation will vary the light intensity by increasing it slowly over time until the light intensity reaches a maximum. At that point, typically the light intensity will begin to decrease slowly until a minimal level is reached which, at that point, the light intensity level will begin to increase once again. In this mode of operation, a user may choose an exact attribute setting if one of the default attribute settings is undesirable.

In another embodiment, the dynamic mode of operation comprises altering the light color over time. For example, the light from light source 106 may be cycled from a dark hue to a light hue and back over time as long as the state change detected at block 404 remains static.

As one or more attributes are cycled during the dynamic mode of operation, the user selects a desired attribute by removing the non-mechanical stimulus from the light fixture 100 when a desired attribute level is achieved. For example, a user might remove a magnet proximate to the light fixture when a desired light intensity level is reached. As the non-mechanical stimulus is removed, switch 110 changes state, and this state change is detected by processor 300 at block 414. At that point, the attribute setting of light source 106 at that point in time is set as the desired attribute setting by processor 300 at block 416. For example, if the light intensity of light source 106 were changing continuously at block 412 and switch 110 changed state at block 414 while the intensity level was 86 lumens, processor 300 would set the intensity level at 86 lumens from that point forward. If the attribute comprised light color, and the color from light source 106 at the time of the state change at block 414 was green, processor 300 would set the light source color to green, until another state change was detected at block 404.

After setting the attribute at block 416, processing returns to block 402, where processor 300 determines when the next state change of switch 110 occurs.

The methods or algorithms described in connection with the embodiments disclosed herein may be embodied directly in hardware or embodied in processor-readable instructions executed by a processor. The processor-readable instructions may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components.

Accordingly, an embodiment may comprise a computer-readable media embodying code or processor-readable instructions to implement the teachings, methods, processes, algorithms, steps and/or functions disclosed herein.

While the foregoing disclosure shows various illustrative embodiments, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

We claim:

1. An adjustable light fixture, comprising:

a housing;

a light source disposed within the housing;

a cover secured to the housing that allows at least some light from the light source to pass;

a light control circuit, coupled to the light source and disposed within the housing, for detecting a state change of a switch and for providing a control signal for varying a light intensity of the light source; and the switch, coupled to the light control circuit and disposed within the housing, comprising contacts that are opened and closed in response to a non-mechanical stimulus external to the housing;

wherein the light intensity is varied by:

changing the state of the switch from a first position to a second position upon application of the non-mechanical stimulus;

changing the state of the switch from the second position to the first position after removing the non-mechanical stimulus within a predetermined time period;

in response to removing the non-mechanical stimulus within the predetermined time period;

detecting the state changes of the reed switch by the light control circuit; and causing the light source to change its light intensity to a predetermined intensity level.

2. The adjustable light fixture of claim 1, wherein each successive state change of the switch from the second position to the first position within the predetermined time period is detected by the light control circuit and the light intensity is changed to one of a plurality of predetermined intensity levels in response thereto.

3. An adjustable light fixture, comprising:

a housing;

a light source disposed within the housing;

a cover secured to the housing that allows at least some light from the light source to pass;

a processor, coupled to the light source and disposed within the housing, for detecting a state change of a reed switch and for providing a control signal for varying an attribute of the light fixture;

the reed switch, coupled to the light control circuit and disposed within the housing, comprising contacts that are opened and closed in response to a magnetic field external to the housing; and a memory for storing a variable-intensity lighting pattern and instructions for causing the processor to alter the attribute by varying the attribute in accordance with the variable-intensity lighting pattern if the processor determines that the magnetic field has been applied to the housing for a time period exceeding a predetermined time period.

4. The adjustable light fixture of claim 3, wherein the variable-intensity lighting pattern comprises a cyclical repetition of a first time period of increasing light intensity followed by a second time period of decreasing light intensity.

5. A method for controlling an attribute of a light fixture, comprising:

detecting application of a non-mechanical stimulus to the light fixture;

changing the state of a switch from a first position to a second position in response to detecting application of the non-mechanical stimulus;

detecting removal of the non-mechanical stimulus from the light fixture;

changing the state of the switch from the second position to the first position in response to detecting removal of the non-mechanical stimulus;

determining that the non-mechanical stimulus has been removed from the light fixture within a predetermined time period after the non-mechanical stimulus was applied to the light fixture; and in response to determining that the non-mechanical stimulus was removed from the light fixture within the predetermined time period after the non-mechanical stimulus was applied to the light fixture, causing changing an attribute of the light fixture in accordance with a predetermined attribute setting.

6. The method of claim 5, wherein the switch comprises a reed switch and the non-mechanical stimulus comprises a magnetic field.

7. The method of claim 6, further comprising:

storing instructions in a memory relating to a variable-intensity lighting pattern;

determining if the non-mechanical stimulus has been applied to the light fixture longer than the predetermined time period; and varying an intensity of the light source in accordance with the variable-intensity lighting pattern if the non-mechanical stimulus has been applied to the light fixture longer than the predetermined time period.

8. The method of claim 7, wherein the variable-intensity lighting pattern comprises a cyclical repetition of a first time period of increasing light intensity followed by a second time period of decreasing light intensity.

9. The method of claim 7, further comprising:

determining that the non-mechanical stimulus has been removed from the light fixture after the predetermined time period has expired; and setting the light fixture to an attribute setting equal to the attribute setting at the time the non-mechanical stimulus was removed from the fixture.

10. The method of claim 5, wherein each successive state change of the switch from the second position to the first position within the predetermined time period is detected by the light control circuit and the light intensity is changed to one of a plurality of predetermined intensity levels in response thereto.

* * * * *